United States Patent [19]

Feuchter et al.

[11] Patent Number: 4,989,401

[45] Date of Patent: Feb. 5, 1991

[54] BRAKE FOR AN OPEN-END SPINNING ROTOR

[75] Inventors: Wolfgang Feuchter, Deggingen-Reichenbach im Täle; Dieter Götz, Geislingen/Steige, both of Fed. Rep. of Germany

[73] Assignee: Wilhelm Stahlecker GmbH, Fed. Rep. of Germany

[21] Appl. No.: 361,314

[22] Filed: Jun. 5, 1989

[30] Foreign Application Priority Data

Jun. 15, 1988 [DE] Fed. Rep. of Germany ..... 3820328

[51] Int. Cl.[5] ..... D01H 4/44

[52] U.S. Cl. ..... 57/88; 57/406

[58] Field of Search ..... 57/88, 404, 405, 406, 57/407, 78, 104

[56] References Cited

U.S. PATENT DOCUMENTS

| | | | |
|---|---|---|---|
| 3,116,591 | 1/1964 | Müller | 57/88 |
| 3,269,103 | 8/1966 | Franzen | 57/88 |
| 4,176,512 | 12/1979 | Schwengeler | 57/88 |
| 4,703,616 | 11/1987 | Feuchter et al. | 57/406 X |
| 4,706,450 | 11/1987 | Feuchter et al. | 57/88 |
| 4,773,210 | 9/1988 | Landwehrkamp et al. | 57/88 |
| 4,785,620 | 11/1988 | Feuchter | 57/406 |

FOREIGN PATENT DOCUMENTS

| | | | |
|---|---|---|---|
| 0148468 | 7/1985 | European Pat. Off. . | |
| 3533717 | 3/1987 | Fed. Rep. of Germany . | |
| 3613843 | 10/1987 | Fed. Rep. of Germany . | |
| 602117 | 5/1948 | United Kingdom | 57/88 |
| 930034 | 7/1963 | United Kingdom | 57/88 |

*Primary Examiner*—Joseph J. Hail, III

*Attorney, Agent, or Firm*—Evenson, Wands, Edwards, Lenahan & McKeown

[57] ABSTRACT

In the case of a brake for an open-end spinning rotor which, by a shaft, is disposed in a wedge-shaped gap of at least one pair of supporting disks, two mirror-symmetrically arranged tong arms are provided which can each be swivelled around an axle extending in parallel to the shaft. The double-armed tong arms, at one arm, are equipped with brake linings which can be applied to the shaft. The arms facing away from the shaft are spread apart by a common actuating element. The actuating element can be moved freely in moving direction of the arms.

13 Claims, 1 Drawing Sheet

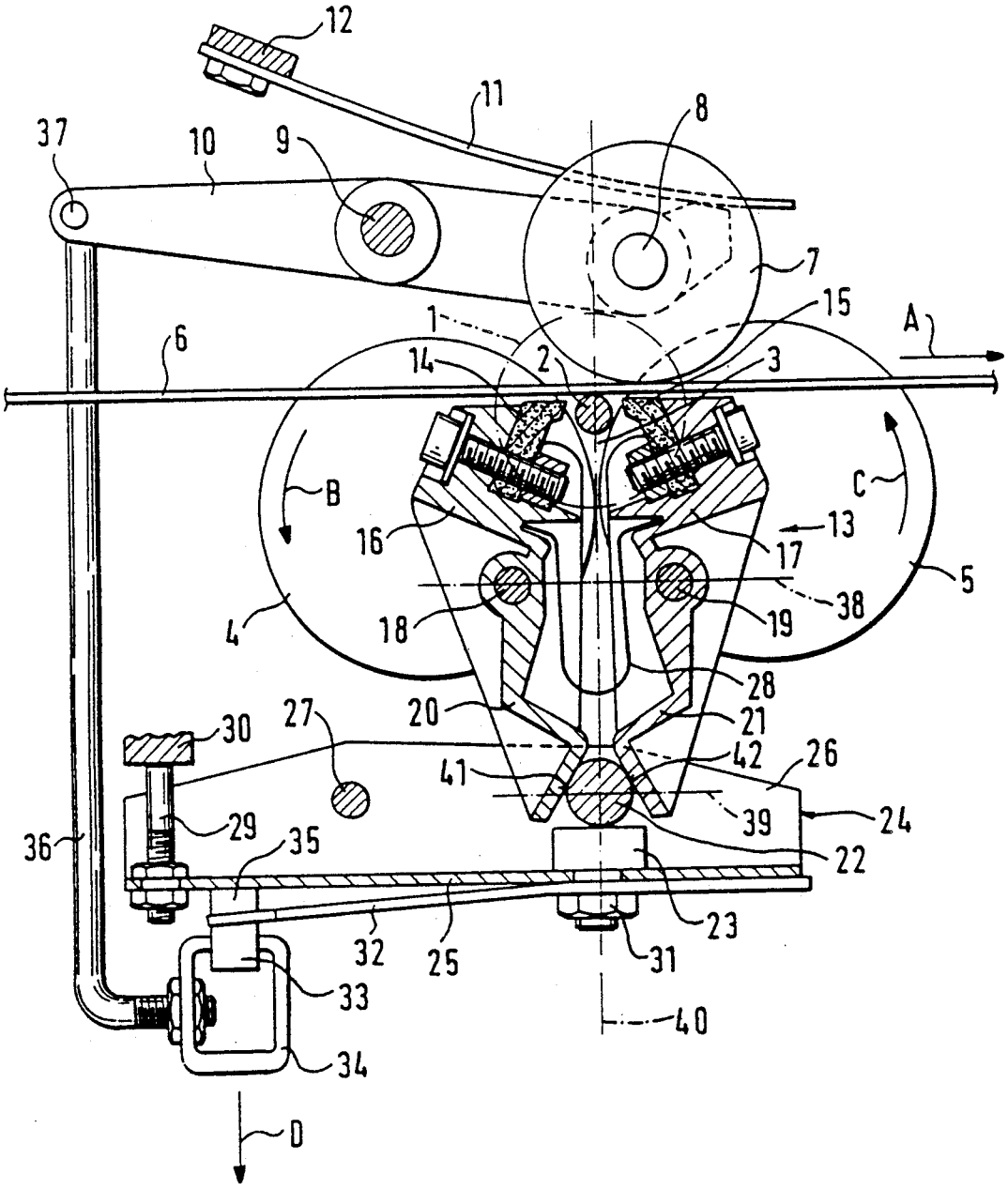
12
11
8
37
10
9
7
15
A
1
6
14
2
3
B
C
16
13
17
5
38
4
18
19
28
20
21
30
27
42
26
41
39
24
29
36
35
22
23
32
25
31
33
40
34
D

BRAKE FOR AN OPEN-END SPINNING ROTOR

BACKGROUND AND SUMMARY OF THE INVENTION

The invention relates to a brake for an open-end spinning rotor which is disposed by means of a shaft in a wedge-shaped gap of at least one pair of supporting disks. The brake has two mirror-symmetrically arranged double-armed tong arms, which can each be swivelled around an axle extending in parallel to the shaft, which carry brake linings at arms that can be applied to the shaft, and which, at the arms that face away from the shaft, can be spread apart by means of a common actuating element.

In a known brake of the initially mentioned type disclosed in commonly assigned U.S. Pat. No. 4,703,616, the actuating element is a bent leaf spring which is pressed in the direction toward the shaft and which deforms in the process and presses apart the arms of the tong arms which are connected with it. In order to ensure in this type of a brake without any high technical expenditures that the shaft of the spinning rotor is securely held in the wedge-shaped gap, it is also known from commonly assigned U.S. Pat. No. 4,706,450 to construct the brake shoes in such a manner, and/or arrange them relative to one another in such a manner, and/or actuate them in such a manner that the brake shoe, which during the braking moves in moving direction of the tangential belt, comes to rest against the shaft first.

In the case of a brake of a slightly different type disclosed in European Patent Application (EP-A) 0148,468, in which two tong levers are provided which are constructed as simple arms, these tong levers are held by means of a spreading element in an unbraked operating position and, by means of a spring, are changed to a braking position when the spreading element is moved away from the arms.

An object of the invention is to construct a brake of the initially mentioned type in such a manner that it is reliably ensured that the brake linings press against the shaft with equally high forces.

This object is achieved in that the actuating element is arranged to be freely movable in moving direction of the arms.

By means of this construction, it is ensured that the spreading forces are introduced into the tong arms by an equal amount, because these tong arms mutually support one another by means of the freely movable actuating element on the one side, and by means of the shaft, on the other side. The forces exercised on the shaft by the two brake linings are therefore always the same so that it is also possible to do without an asymmetrical arrangement and/or an asymmetrical actuating, and to apply the brake linings to the shaft simultaneously.

In a further development of preferred embodiments of the invention, it is provided that the arms of the tong arms facing away from the shaft are provided with sliding surfaces which enclose a preferably acute angle between one another and between which a spreading element can be inserted which is centered by the sliding surfaces. In order to ensure that the loading of the spreading element does not result in any varying introduction of force, it is further provided in an expedient development that the spreading element is supported by a loading element in such a manner that the direction of force from the loading element to the spreading element extends in the median line of the sliding surfaces.

In particularly advantageous embodiments of the invention, it is provided that the spreading element is a rotationally symmetrical body which is disposed opposite the sliding surfaces and the loading element at angular distances of 120°. This development ensures that, also during an adjusting movement of the actuating devices, the relationships and directions of force remain the same.

In an advantageous embodiment of the invention, the actuating element is a cylindrical body. In a particularly simple manner, it is provided that the actuating element is disposed in a U-shaped guide which is formed by a swivelling lever, which can be swivelled around an axle which is in parallel to the axles of the tong arms, and which carries the loading element. This actuating element is basically inserted only loosely and is held in the respective required position by the loading element and the sliding surfaces.

Other objects, advantages and novel features of the present invention will become apparent from the following detailed description of the invention when considered in conjunction with the accompanying drawings.

BRIEF DESCRIPTION OF THE DRAWINGS

The single drawing FIGURE shows a cross-section of a supporting disk bearing for a spinning rotor with a brake that is constructed according to a preferred embodiment of the invention.

DETAILED DESCRIPTION OF THE DRAWINGS

In the drawing, the rotor 1 of a spinning rotor is shown only by means of a dash-dotted line. The rotor 1 is non-rotatably connected with a shaft 2 which is disposed in the wedge-shaped gaps 3 of two pairs of supporting disks, of which in the sectional representation, only the pair of supporting disks is shown that is formed by supporting disks 4, 5. The shaft 2, which is disposed in the wedge-shaped gaps 3 horizontally, is driven by means of a tangential belt 6 moving in the longitudinal direction (arrow A) of the machine and driving the shafts 2 of all spinning rotors of the spinning units of one side of the machine. Supporting disks 4, 5 as well as the supporting disks which are not shown are set into rotation by means of the shaft 2 so that they rotate in the direction of the arrows (B and C). The tangential belt 6 rests against the shaft 2 from above and thus presses it into the wedge-shaped gaps 3 of the pairs of supporting disks so that the shaft 2 is secured in the wedge-shaped gaps 3 during the operation.

The tangential belt 6 is loaded in the direction of the shaft 2 by means of a tension roller 7. The tension roller 7 is arranged on a lever 10 so that it can be rotated freely around an axle 8, this lever 10 being pivotable around a stationary axle 9. A loading spring 11 rests against the lever 10 and loads the tension roller 7 by means of forces determined by prestressing in the direction of the wedge-shaped gap 3. The loading spring 11, which is constructed as a leaf spring, is fastening at a stationary fixing point 12.

A brake 13 is assigned to the spinning rotor by means of which the shaft 2 is clamped in in the manner of tongs and is braked. This brake 13 is arranged between the pairs of supporting disks in the area below the tangential belt 6. It is constructed in such a manner that no additional space is required laterally next to the tangential belt 6. The brake 13 contains two tong arms 16, 17, which can be swivelled around stationary axles 18, 19 extending in parallel to shaft 2 and arranged below this shaft 2. The arms of the tong arms 16, 17, which face the shaft 2, carry brake linings 14, 15 which can be applied to the shaft 2 in such a manner that they also have a component of motion in a direction leading into the wedge-shaped gap 3.

The two arms 20, 21 of the mirror-symmetrically arranged tong arms 16, 17, which face away from the brake linings 14, 15, are provided with sliding surfaces 41, 42, which enclose an obtuse or an acute angle between one another, preferably an angle of slightly less than 90°. The median line 40 between the sliding surfaces 41, 42 extends through the axis of the shaft 2.

A spreading element 22 can be pressed between the two sliding surfaces 41, 42 of the arms 20, 21, so that the two arms 20, 21 are spread apart and the brake linings 14, 15 are applied to the shaft 2. The return movement is caused by means of a U-spring 28 which is arranged between the arms 20, 21 of the tong arms 16, 17 carrying the brake linings 14, 15.

The spreading element 22 is constructed as a cylindrical roller which is preferably made of a wear-resistant plastic material. The axis of the roller 22 extends in parallel to axles 18, 19 and to shaft 2. The roller 22 is supported by a plate 23, which is arranged on a brake lever 24 such that, by means of the counterclockwise swivelling of the brake lever 24, the roller 22 is pressed deeper into the sliding surfaces 41, 42. The brake lever 24 has a U-shaped cross-section, the open side of which points upward. The roller 22 is guided between the two legs 26 with a narrow axial distance. The plate 23, which serves as the loading element, is fastened at the transverse web 25 of the brake lever 24.

The roller 22 thus, in each case, supports itself at angular distances of 120° at the plate 23 and the two sliding surfaces 41, 42. It is otherwise freely movable, i.e., particularly in moving direction of the arms 20, 21. As a result, it is ensured that forces transmitted by the roller 22 on the tong arms 16, 17 and thus by the brake linings 14, 15 on the shaft 2 mutually compensate one another and are therefore identical.

The brake lever 24 can be swivelled around a stationary shaft 27 extending in parallel to shafts 18, 19 in such a manner that the applying motion of the roller 22 takes place in the median line 40. This median line 40 extends approximately perpendicular to a plane 39 containing the shaft 27 and the roller 22, and particularly perpendicular to the plane 38 connecting the shafts 18 and 19.

The actuating of the brake 13 takes place by means of an actuating mechanism which, at the same time, causes a lifting of the tension roller 7 off the tangential belt 6 and thus an unloading of the tangential belt 6. The lever 10, by means of a connecting rod 36 hinged to a joint 37, is connected with an actuating element 34 which can be moved in the direction of the arrow (D). This actuating element 34, by means of a driving device 33, is pivotally connected to a leaf spring 32 which is prestressed to a certain value by member 35 and which, by means of a nut 31, is fastened at the web 25 of the brake lever 24. The shown inoperative position of the brake lever 24, into which this brake lever 24 is pressed by means of the U-spring 28, is secured by means of a stop pin 29 which is mounted at the brake lever 24 and which comes to rest at a stationary stop 30.

By means of a pulling movement in the direction of the arrow (D), the brake lever 24 is therefore swivelled counterclockwise around the axle 27, because this loading is applied to the axle 27 by means of a corresponding lever arm. As a result, the roller 22 is pressed deeper between the sliding surfaces 41, 42, so that the brake linings 14, 15 are applied to the shaft 2. As soon as the brake linings 14, 15 rest against the shaft 2, any further movement in the direction of the arrow (D) is absorbed by the leaf spring 32, so that the braking force is limited. During a movement in the direction of the arrow (D), the lever 10, by means of the connecting rod 36, is swivelled against the effect of the loading spring 11, so that the tension roller 7 is lifted off the tangential belt 6. When the actuating of the brake is lifted, i.e., the actuating element 34 is released, it automatically returns into the shown position against the arrow (D). In this case, the prestressed leaf spring 32 has the effect that the driving device 33 will again rest against the web 25 of the brake lever 24. The U-spring 28 presses apart the two tong arms 16, 17, whereby the roller 22 is pushed back downward between the sliding surfaces 41, 42 until the stop pin 29 comes to rest against the stop 30. The loading sPring 11 presses the lever 10 back into the shown operative position so that the tension roller 7 again loads the tangential belt 6.

Although the present invention has been described and illustrated in detail, it is to be clearly understood that the same is by way of illustration and example only, and is not to be taken by way of limitation. The spirit and scope of the present invention are to be limited only by the terms of the appended claims.

We claim:

1. A brake for selectively braking an open-end spinning rotor shaft comprising:

first and second mirror-symmetrically arranged double-armed tong arms pivotally mounted at respective first and second brake axles extending parallel to the rotor shaft, each of said tong arms containing brake linings for engaging the rotor shaft when the tong arms are moved to a braking position, and a common brake actuating element slidably engagable with both tong arms at brake actuation surfaces disposed on a side of the brake axles opposite the location of the rotor shaft, said brake actuating element being only in contact with the brake actuation surfaces and being freely movable with respect to both tong arms so as to accommodate and assure application of equal simultaneous braking forces at the brake actuating surfaces of both tong arms caused by movement of the brake actuating element toward the rotor shaft.

2. A brake according to claim 1, wherein the arms of the tong arms which face away from the shaft are provided with the brake actuating surfaces, said brake actuating surfaces being sliding surfaces which enclose an actuate angle between one another, said brake actuating element being configured as a spreading element which is inserted between and centered by the sliding surfaces.

3. A brake according to claim 2, wherein the spreading element is supported by means of a loading element such that the direction of force extends from the loading element to the spreading element in a median line of the sliding surfaces.

4. A brake according to claim 3, wherein the spreading element is a rotationally symmetrical body which is disposed opposite the sliding surfaces and the loading element at angular distances of 120°.

5. A brake according to claim 4, wherein the actuating element is a cylindrical body.

6. A brake according to claim 4, comprising a swivelling lever, wherein the actuating element is disposed in a U-shaped guide which is formed by the swivelling lever which can be swivelled around an axle which is parallel to the first and second brake axles of the tong arms, this swivelling lever carrying a loading element for engaging the actuating element to push the same toward a braking position.

7. A brake according to claim 4, comprising a swivelling lever, wherein the actuating element is disposed in a U-shaped guide which is formed by the swivelling lever which can be swivelled around an axle which is parallel to the first and second brake axles of the tong arms, this swivelling lever carrying a loading element for engaging the actuating element to push the same toward a braking position.

8. A brake according to claim 3, wherein the spreading element is a rotationally symmetrical body which is disposed opposite the sliding surfaces and the loading element at angular distances of 120°.

9. A brake according to claim 3, comprising a swivelling lever, wherein the actuating element is disposed in a U-shaped guide which is formed by the swivelling lever which can be swivelled around an axle which is parallel to the first and second brake axles of the tong arms, this swivelling lever carrying a loading element for engaging the actuating element to push the same toward a braking position.

10. A brake according to claim 2, wherein the actuating element is a cylindrical body.

11. A brake according to claim 2, comprising a swivelling lever, wherein the actuating element is disposed in a U-shaped guide which is formed by the swivelling lever which can be swivelled around an axle which is parallel to the first and second brake axles of the tong arms, this swivelling lever carrying a loading element for engaging the actuating element to push the same toward a braking position.

12. A brake according to claim 1, wherein the actuating element is a cylindrical body.

13. A brake according to claim 1, comprising a swivelling lever, wherein the actuating element is disposed in a U-shaped guide which is formed by the swivelling lever which can be swivelled around an axle which is parallel to the first and second brake axles of the tong arms, this swivelling lever carrying a loading element for engaging the actuating element to push the same toward a braking position.

* * * * *